US005240466A

United States Patent [19]

Bauer et al.

[11] Patent Number: 5,240,466

[45] Date of Patent: Aug. 31, 1993

[54] DYEING LEATHER WITH WATER-INSOLUBLE SULPHUR DYES

[75] Inventors: Wolfgang Bauer, Maintal; Hubert Kruse, Königstein; Gert Nagl, Niederdorfelden; Jan-Hilbert Mast, Hünfelden; Lothar Schlösser, Frankfurt am Main, all of Fed. Rep. of Germany

[73] Assignee: Casella Aktiengesellschaft, Frankfurt, Fed. Rep. of Germany

[21] Appl. No.: 834,669

[22] Filed: Feb. 12, 1992

[30] Foreign Application Priority Data

Feb. 23, 1991 [DE] Fed. Rep. of Germany ..... 4105772

[51] Int. Cl.[5] ..... C09B 49/00; D06P 1/30; D06P 3/32

[52] U.S. Cl. ..... 8/436; 8/437; 8/637.1; 8/650; 8/652; 8/680; 8/642

[58] Field of Search ..... 8/436, 650, 652, 637.1, 8/642

[56] References Cited

U.S. PATENT DOCUMENTS

| | | | |
|---|---|---|---|
| 622,563 | 4/1999 | Sykes | 8/436 |
| 1,841,007 | 1/1932 | Brunner | 8/436 |
| 1,993,523 | 3/1935 | Poschel | 8/436 |
| 2,109,372 | 6/1934 | Hinds et al. | 8/568 |
| 2,125,981 | 8/1938 | Barnhart et al. | 8/652 |
| 4,582,509 | 4/1986 | Buhler et al. | 8/532 |
| 4,645,511 | 2/1987 | Heller et al. | 8/549 |
| 4,717,389 | 1/1988 | Seitz | 8/436 |
| 4,717,390 | 1/1988 | Dien | 8/436 |
| 4,838,896 | 6/1989 | Kissling et al. | 8/554 |
| 4,950,305 | 8/1990 | Buhler et al. | 8/639 |
| 5,007,941 | 4/1991 | Martinelli et al. | 8/436 |

FOREIGN PATENT DOCUMENTS

| | | |
|---|---|---|
| 497238 | 8/1992 | European Pat. Off. . |
| 47-031393 | 8/1972 | Japan . |
| 2226051 | 6/1990 | United Kingdom . |

OTHER PUBLICATIONS

Chemical Abstracts, vol. 78, No. 14, JP-A-7 231 393, Abstract No. 85829, "Coloring of fiber materials with aqueous coloring agents", Apr. 9, 1973.

*Primary Examiner*—A. Lionel Clingman
*Attorney, Agent, or Firm*—Connolly and Hutz

[57] ABSTRACT

The present invention relates to a process for dyeing leather by the exhaust method, characterized in that water-insoluble sulphur dyes in dispersed form are used.

18 Claims, No Drawings

DYEING LEATHER WITH WATER-INSOLUBLE SULPHUR DYES

The present invention relates to a process for dyeing leather with water-insoluble sulphur dyes in a finely divided dispersed form from an aqueous liquor by the exhaust method without the addition of reducing and/or oxidising agents.

It is already known to use water-insoluble sulphur dyes in finely divided dispersed form for dyeing cotton fibres (Textile J. Australia 1972, 22; Melliand Textilber. 12, 833 (1984)).

In this dyeing process, the water-insoluble sulphur dye is first converted with reducing agents into the water-soluble leuco form, which goes onto the cotton fibre and is then oxidised on the fibre with oxidising agents into the water-insoluble form. This known dyeing process is described for example in the following review articles: Melliand Textilber. 12, 1314 (1973); Ullmann's Enzyklopädie der Technischen Chemie, Vol. 21, 65 (1982); Rev. Progr. Coloration, Vol. 7, 80 (1976)). If no reducing agent is used, no dye fixation occurs on the cotton fibre which has been impregnated with finely dispersed sulphur dye.

Water-soluble sulphur dyes can be used not only for the known purpose of dyeing cellulose fibres but also for dyeing nontextile fibre materials, for example for dyeing chrome-tanned leathers (Rev. Progr. Coloration, Vol. 7, 83 (1976)).

If the water-soluble sulphur dyes used are Bunte salts. (K. Venkataraman, The Chemistry of Synthetic Dyes, Vol. VII, 36 (1974), the dyeing methods customary for acid dyes produce weak dyeings (Leather 178, 27 (1976)) with good penetration (Leather 177, 4406 (1975)). Owing to their low substantivity, these Bunte salts do not give complete exhaustion on leather and greatly pollute the dyehouse effluent. Deeper dyeings with Bunte salts can be obtained only if specific auxiliaries are used at the same time (German Patents 3,601,721, 3,617,636), in which case the auxiliaries likewise remain as pollutants in the dyehouse effluent.

Similarly, the use of water-soluble sulphur dyes in the leuco form is already known for dyeing leather (British Patent 1,502,966; Leather 179, 4421 (1977); Leather 178, 59 (1976); Leather 178, 4407 (1976); Leather 178, 27 (1976)). Owing to the high pH values which are set in dyeings with leuco sulphur dyes through the use of reducing agents such as sodium sulphide or glucose and alkali metal hydroxide, fibre damage causes undesirable hardening of the leather (J. Soc. Dyers Color. 100. 262 (1984)).

It is also already known to dye surfaces of fibre materials, such as cotton, polyester, polyamide or leather, with aqueous dispersions of sparingly water-soluble anthraquinone, indigo, sulphur and phthalocyanine dyes, these dispersions containing crosslinkable resins which are applied to and baked on the fibres at 160° C. (Japanese Patent 7 231 393, Chem. Abstr. 78, 85 829 (1973)).

It has now been found, surprisingly, that leather can be dyed under customary leather dyeing conditions (cf. for example K. Venkataraman, The Chemistry of Synthetic Dyes, Vol. VIII, 37 (1978) and references cited therein) with water-insoluble sulphur dyes in a finely divided dispersed form from an aqueous liquor in an effective manner. No reducing and/or oxidising agent needs to be added.

The present invention accordingly provides a process for dyeing leather by the exhaust method, characterised in that water-insoluble sulphur dyes in dispersed form are used.

It is advantageous to pretreat the leather for dyeing in a manner which is customary in the known exhaust dyeing process involving water-soluble leather dyes (see for example K. Eitel, Das Färben von Leder, Volume 5, pp. 269 ff., Umschau-Verlag, Frankfurt/m. (1987)). Similarly, the process according to the present invention is itself advantageously carried out under the dyeing conditions which are customary for the known exhaust dyeing process involving water-soluble leather dyes.

For example, the leather is dyed in an aqueous liquor which, based on the shaved weight of the leather, contains from 20 to 400%, preferably from 50 to 200%, of water at a temperature of from 20 to 100° C., preferably from 30 to 60° C., with from 0.5 to 8%, preferably from 1.5 to 6%, of dispersed sulphur dyes in pigment form. The pH is preferably within the range from 3.8 to 5.5.

If desired, the sulphur dyes in dispersed form can be combined with a dispersion of an inorganic or organic pigment and/or with a water-soluble acid or direct dye. Pigment dispersions are preferably used in amounts of from 0.1 to 6% by weight, particularly preferably from 0.1 to 3% by weight, based on the shaved weight of the leather.

Water-soluble acid or direct dyes are preferably used in amounts of from 0.1 to 6% by weight, particularly preferably from 0.1 to 4% by weight, based on the shaved weight of the leather.

The dispersed sulphur dyes can be combined in the dyeing liquor with the other colorants mentioned in any order. In addition, it is possible to mix the individual colour components even before they are introduced into the dyeing liquor.

The total dyeing time is normally from 20 to 300, preferably from 30 to 120, minutes.

The dyebath may be admixed before, during or after the dyeing with further additions, for example wetting or dispersing agents, levelling agents, colour deepening agents and/or fatliquoring agents. Effective colour deepening agents are surprisingly salts, such as sodium sulphite, sodium hydrogen sulphite or sodium pyrosulphide.

The entire dyeing process is normally completed by lowering the pH of the dyeing liquor, to pH 3.8–5.5, preferably with formic acid.

The added formic acid is customarily allowed to act for from 10 to 60 minutes.

The dyed leather is then dressed and finished in a conventional manner.

The water-insoluble sulphur dyes used in the process according to the present invention are present in dispersed form and preferably have an average particle size of from 10 nm to 2000 nm, particularly preferably of from 50 nm to 1000 nm.

The finely divided sulphur dye dispersions are obtained in a conventional manner by milling the water-insoluble sulphur dyes in suitable milling equipment, for example in bead or sand mills, preferably in the presence of dispersants. Possible dispersants are preferably anionic surfactants and/or amphoteric surfactants and/or nonionic and/or cationic surfactants. An overview of suitable surfactants may be found for example in Ullmann's Enzyklopädie der Technischen Chemie, Volume 16, 724–742 (1965), Volume 22, 455–516 (1982), A 8, 315–350 (1987); E. H. Daruwalla in K. Venkataraman, The Chemistry of Synthetic Dyes, Vol. VII, pages 86–92 (1974). If sulphur dye dispersions are used in aqueous paste form, they may additionally contain organic solvents, for example from the series of the monohydric or polyhydric alcohols, polydiols or polyethylene or polypropylene glycols, and/or conventional preservatives in order to lengthen the storage life.

As dispersed sulphur dyes in pigment form it is possible to use yellow, red, blue, green, brown and black sulphur dyes which are obtainable by known methods, for example by baking or boiling aromatic compounds with sulphur or alkali metal polysulphides, or by special techniques, for example using disulphur dichloride. It is also possible to use sulphur dyes based on copper phthalocyanine, perylenetetracarboxylic acid and also oxazine dyes.

The preparation of sulphur dyes is described for example in Ullmann's Enzyklopädie der Technischen Chemie, Volume 21, pages 65 ff. (1982); K. Venkataraman, The Chemistry of Synthetic Dyes, Vol. II, pages 1059–1100 (1952); Vol. VII, pages 1–32 (1974); Kirk-Othmer 19, 424–441; 22, 168–189; Melliand Textilber. 60, 254–256 (1979).

Preferred sulphur dyes which in finely divided dispersed form can be used in the dyeing process according to the present invention are for example the sulphur dyes listed in the Colour Index, Vol. 5, 3rd Edition (1982) and (1987):

Sulphur Black 1, Sulphur Black 2, Sulphur Black 6, Sulphur Black 8, Sulphur Black 9, Sulphur Black 11, Sulphur Brown 1, Sulphur Brown 10, Sulphur Brown 12, Sulphur Brown 15, Sulphur Brown 16, Sulphur Brown 20, Sulphur Brown 21, Sulphur Brown 31, Sulphur Brown 38, Sulphur Brown 46, Sulphur Brown 51, Sulphur Brown 52, Sulphur Brown 60, Sulphur Brown 93, Sulphur Brown 96;

Sulphur Blue 2, Sulphur Blue 5, Sulphur Blue 6, Sulphur Blue 7, Sulphur Blue 10, Sulphur Blue 11, Sulphur Blue 12, Sulphur Blue 13;

Sulphur Orange 2;

Sulphur Green 2, Sulphur Green 3, Sulphur Green 5, Sulphur Green 8, Sulphur Green 9, Sulphur Green 12, Sulphur Green 19, Sulphur Green 25, Sulphur Green 26, Sulphur Green 36, Sulphur Green 37, Sulphur Green 38, Sulphur Red 3, Sulphur Red 4, Sulphur Red 5, Sulphur Red 6, Sulphur Red 10, Sulphur Red 11, Sulphur Red 12, Sulphur Red 14;

Sulphur Violet 3;

Sulphur Yellow 5, Sulphur Yellow 19, Sulphur Yellow 20.

Preferred sulphur vat dyes are for example Vat Blue 42,

Vat Blue 43, Vat Blue 47, Vat Green 14.

Particularly preferred sulphur dyes and sulphur vat dyes are:

Sulphur Black 1, Sulphur Black 2, Sulphur Black 6, Sulphur Black 8, Sulphur Black 11;

Sulphur Brown 51, Sulphur Brown 96;

Sulphur Green 36;

Vat Green 14;

Sulphur Red 10, Sulphur Red 14.

Preferred pigments which in combination with finely dispersed sulphur dyes of the kind mentioned can be used in the dyeing process according to the present invention are for example: black pigments based on elemental carbon, e.g. Pigment Black 6, 7, 8, 9, 10, Pigment Yellow 74, Pigment Orange 34, Pigment Orange 36, Pigment Brown 1, Pigment Red 112, Pigment Blue 15:3. Particular preference is given to Pigment Black 7.

Preferred acid and direct dyes which in combination with finely dispersed sulphur dyes of the kind mentioned can be used in the dyeing process according to the present invention are for example: Solubilised Sulphur Black 1, Direct Black 168.

The process according to the present invention is suitable for all kinds of leather, for example mineral or vegetable tanned grain, raised, suede or nubuck leather, from cow, goat, sheep or pig.

All kinds of leather are dyed a level shade of high colour strength with good fastness properties, in particular good light fastness, wet fastness, wet and dry rub fastness, fatliquoring fastness, solvent fastness, perspiration fastness and diffusion fastness in relation to plasticised PVC.

What is surprising is in particular the deep penetration of colour into the leathers dyed by the process according to the present invention. More particularly, the disadvantages of existing dyeing processes involving Bunte salts (low substantivity, high effluent pollution) and leuco sulphur dyes (fibre damage due to high pH) and dye dispersions in the presence of crosslinkable resins (high energy consumption due to dyeing at 160° C.) are notable for their absence.

In the examples which follow, percentages are by weight, based on the shaved weight (Examples 1 to 4) or the dry weight (Examples 2 and 3) of the leather.

EXAMPLE 1

Dyeing of chrome tanned moist leather for use as shoe uppers. The following operations are carried out:

| Operation | Amount | Product | Temperature | Time |
|---|---|---|---|---|
| Neutralisation | 150.0% | Water | 35° C. | |
| | 1.5% | Sodium formate | | 30 min |
| | 0.5% | Sodium bicarbonate | | 30 min |
| Rinsing | 50.0% | Water | 25° C. | |
| Dyeing, retanning, fatliquoring | 4.0% | Dispersed sulphur dye (40%) Colour Index Sulphur Brown 51 | | |
| | 1.0% | Ammonia (25%) | | 40 min |
| | 4.0% | Commercially available vegetable tanning, for example Mimosa | | 40 min |
| | 8.0% | Chlorosulphonated saturated linear $C_{24}$—$C_{30}$-fat | | 40 min |
| | 100.0% | Water | 60° C. | |
| | 3.0% | Formic acid (85%) | | 40 min |

The dyed leather is finished by rinsing with water, setting out, drying at from 50° to 60° C. and milling.

EXAMPLE 2

Dyeing of purely vegetable tanned dry leather for use as furniture leather. The following operations are carried out:

| Operation | Amount | Product | Temperature | Time |
|---|---|---|---|---|
| Wetting back | 700.0% | Water | 40° C. | |
| | 4.0% | Oxysulphited fish oil | | 120 min |
| Dropping the | 500.0% | Water | 35° C. | |

-continued

| Operation | Amount | Product | Temperature | Time |
|---|---|---|---|---|
| liquor | | | | |
| Washing | 300.0% | Water | 35° C. | |
| Predyeing and fatliquoring | 0.8% | Stearylamine with 12 ethylene oxide units | | 10 min |
| | 0.5% | Polyglycol of molecular weight about 6000 | | |
| | 1.0% | Ammonia (25%) | | 25 min |
| | 6.0% | Dispersed sulphur dye (40%) Colour Index Sulphur Brown 51 | | 45 min |
| | 6.0% | Oxysulphited fish oil | | 30 min |
| | 3.0% | Formic acid (85%) | | 20 min |
| Rinsing | 500.0% | Water | 55° C. | |
| Cross-dyeing | 500.0% | Water | 55° C. | |
| | 1.0% | Polyacrylic acid of molecular weight about 1000 | | 10 min |
| | 0.1% | Primary tallow fat amine | | 10 min |
| | 2.0% | Melamine-formaldehyde-urea condensation product | | |
| | 1.0% | Dispersed sulphur dye (40%) Colour Index Sulphur Brown 51 | | |
| | 0.5% | Pigment dispersion (30%) Colour Index P.Br. 1 | | |
| | 1.0% | Pigment dispersion (22%) Colour Index P.O. 36 | | |
| | 2.0% | Pigment dispersion (40%) Colour Index Pigment White 77891 | | 60 min |
| | 1.0% | Formic acid (85%) | | 10 min |
| | 1.5% | Formic acid (85%) | | 10 min |

The dyed leather is finished as described in Example 1.

EXAMPLE 3

Dyeing of chrome-tanned, retanned and fatliquored dry leather for use as furniture leather. The following operations are carried out:

| Operation | Amount | Product | Temperature | Time |
|---|---|---|---|---|
| Wetting back | 1000.0% | Water | 45° C. | |
| | 2.0% | Ammonia (25%) | | 120 min |
| Rinsing | 400.0% | Water | 45° C. | |
| Dyeing | 1.0% | Ammonia (25%) | | 10 min |
| | 3.0% | Dispersed sulphur dye (40%) C.I. Sulphur Brown 51 | | |
| | 1.5% | Commercially available water-soluble azo brown dye C.I. 14615, Acid Brown 102 | | 60 min |
| | 1.5% | Formic acid (85%) new liquor | | 20 min |
| Cross-dyeing | 400.0% | Water | 45° C. | |
| | 1.5% | Dispersed sulphur dye (40%) C.I. Sulphur Brown-51 | | |
| | 0.8% | Commercially available water-soluble azo brown dye C.I. 14615, Acid Brown 102 | | 30 min |
| | 0.5% | Formic acid (85%) | | 20 min |

The dyed leather is finished as described in Example 1.

EXAMPLE 4

Dyeing of chrome tanned moist leather for use as shoe uppers. The following operations are carried out:

| Operation | Amount | Product | Temperature | Time |
|---|---|---|---|---|
| Washing | 300.0% | Water | 40° C. | 10 min |
| Neutralisation | 150.0% | Water | 40° C. | |
| | 1.5% | Sodium formate | | 30 min |
| | 1.0% | Sodium bicarbonate | | 60 min |
| Dyeing and pigmenting | 50.0% | Water | 30° C. | |
| | 0.8% | Ammonia (25%) | | 10 min |
| | 2.0% | m-Benzenedisulphonic acid (disodium salt) | | 15 min |
| | 4.5% | Dispersed sulphur dye (40%) C.I. Sulphur Black 11 | | |
| | 2.0% | Carbon black dispersion (40%) C.I. Pigment Black 7 | | 45 min |
| | 1.0% | Melamine-formaldehyde-urea condensation product | | 15 min |
| Retanning | 10.0% | Dihydroxydiphenyl sulphone-naphthalene-sulphonic acid-formaldehyde condensation product | | |
| | 100.0% | Water | 75° C. | |
| | 8.0% | Oxysulphited fish oil | | 45 min |
| | 3.0% | Formic acid (85%) | | 20 min |
| New liquor | 150.0% | Water | 50° C. | |
| Top dyeing and fixation | 1.0% | Dispersed sulphur dye (40%) C.I. Sulphur Black 11 | | 30 min |
| | 1.0% | Carbon black dispersion (40%) Pigment Black 6 | | |
| | 1.0% | Formic acid (85%) | | 20 min |
| | 0.5% | Dicyandiamide-formaldehyde condensation product | | 20 min |

The dyed leather is finished as described in Example 1.

We claim:

1. Process for dyeing leather by the exhaust method, characterized in that water-insoluble sulphur dyes in dispersed form are used.

2. Process for dyeing leather according to claim 1, characterized in that the dispersed water-insoluble sulphur dyes have a particle size of from 10 nm to 2000 nm.

3. Process for dyeing leather according to claim 1, characterized in that the dispersed water-insoluble sulphur dyes have a particle size of from 50 nm to 1000 nm.

4. Process for dyeing leather according to claim 1, characterized in that the dispersed water-insoluble sulphur dyes have been dispersed with the aid of anionic surfactants, amphoteric surfactants, cationic surfactants or nonionic surfactants.

5. Process for dyeing leather according to claim 1, characterized in that the water-insoluble sulphur dyes used are Sulphur Black 1, Sulphur Black 2, Sulphur Black 6, Sulphur Black 8, Sulphur Black 11, Sulphur Brown 51, Sulphur Brown 96, Sulphur Green 36, Vat Green 14, Sulphur Red 10, Sulphur Red 14.

6. Process for dyeing leather according to claim 1, characterized in that the dispersed water-insoluble sulphur dyes are combined with a dispersion of an inorganic or organic pigment or with a water-soluble acid or direct dye.

7. Process for dyeing leather according to claim 6, characterized in that the pigment used is Pigment Black, 6, 7, 8, 9, 10, Pigment Yellow 74, Pigment Orange 34, Pigment Orange 36, Pigment Brown 1, Pigment Red 112 or Pigment Blue 15:3.

8. Process for dyeing leather according to claim 6, characterized in that the acid or direct dyes used are Solubilised Sulphur Black 1 or Direct Black 168.

9. Process for dyeing leather by the exhaust method, comprising using water-insoluble sulphur dyes in dispersed form in an aqueous liquor at a temperature of from 20° to 100° C. and a pH-value of from 3.8 to 5.5.

10. Process for dyeing leather by the exhaust method, comprising using 0.5 to 8%, based on the shaved weight of the leather, of water-insoluble sulphur dyes in dispersed form in an aqueous liquor which, based on the shaved weight of the leather, contains from 20 to 400% of water at a temperature of from 20° to 100° C. and a pH value of from 3.8 to 5.5.

11. Process for dyeing as claimed in claim 9, wherein the temperature is from 30° to 60° C.

12. Process for dyeing leather as claimed in claim 10, wherein 1.5 to 6%, based on the shaved weight of leather, of water-insoluble sulphur dyes in dispersed form are used in an aqueous liquor which, based on the shaved weight of the leather, contains from 50 to 200% of water at a temperature of from 30° to 60° C.

13. Process as claimed in claim 6, wherein the water-soluble acid or direct dye are used in amounts from 0.1 to 6% by weight, based on the shaved weight of the leather.

14. Process as claimed in claim 13, wherein the water-soluble acid or direct dyes are used in amounts from 0.1 to 4% by weight, based on the shaved weight of the leather.

15. Process for dyeing leather as claimed in claim 6, wherein the pigment dispersion are used in amounts from 0.1 to 6% by weight, based on the shaved weight of the leather.

16. Process for dyeing leather as claimed in claim 15, wherein the pigment dispersion are used in amounts from 0.1 to 3% by weight, based on the shaved weight of the leather.

17. Process for dyeing leather as claimed in claim 1, wherein the total dyeing time is from 20 to 300 minutes.

18. Process for dyeing leather as claimed in claim 17, wherein the total dyeing time is from 30 to 120 minutes.

* * * * *

UNITED STATES PATENT AND TRADEMARK OFFICE

CERTIFICATE OF CORRECTION

PATENT NO. : 5,240,466

DATED : August 31, 1993

INVENTOR(S) : Bauer, et al

It is certified that error appears in the above-indentified patent and that said Letters Patent is hereby corrected as shown below:

On the title page: Item [73] Assignee: "Casella" should read --Cassella -- therefor.

Signed and Sealed this

Twenty-fourth Day of May, 1994

Bruce Lehman

*Attest:*

BRUCE LEHMAN

*Attesting Officer*

*Commissioner of Patents and Trademarks*